US010105946B2

(12) United States Patent
Nakamura et al.

(10) Patent No.: US 10,105,946 B2
(45) Date of Patent: Oct. 23, 2018

(54) FLUID EJECTION DEVICE

(71) Applicant: Seiko Epson Corporation, Tokyo (JP)

(72) Inventors: Shinichi Nakamura, Okaya (JP); Takahiro Katakura, Okaya (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/639,268

(22) Filed: Jun. 30, 2017

(65) Prior Publication Data

US 2018/0022105 A1 Jan. 25, 2018

(30) Foreign Application Priority Data

Jul. 21, 2016 (JP) ..... 2016-143103

(51) Int. Cl.

| | |
|---|---|
| ***B41J 2/02*** | (2006.01) |
| ***B41J 2/175*** | (2006.01) |
| ***B41J 2/025*** | (2006.01) |
| ***B41J 2/03*** | (2006.01) |
| ***B41J 2/045*** | (2006.01) |

(52) U.S. Cl.

CPC ..... *B41J 2/02* (2013.01); *B41J 2/025* (2013.01); *B41J 2/03* (2013.01); *B41J 2/045* (2013.01); *B41J 2/17596* (2013.01)

(58) Field of Classification Search

CPC ..... B41J 2/02; B41J 2/025; B41J 2/03; B41J 2/045; B41J 2/17596; B65D 83/00; B05C 5/02

See application file for complete search history.

(56) References Cited

U.S. PATENT DOCUMENTS

| | | | |
|---|---|---|---|
| 5,683,544 | A | 11/1997 | Kopp |
| 6,191,522 | B1 | 2/2001 | Reuter |
| 8,746,595 | B2 | 6/2014 | Margheritis et al. |
| 9,156,054 | B2 | 10/2015 | Ikushima |

(Continued)

FOREIGN PATENT DOCUMENTS

| | | | |
|---|---|---|---|
| EP | 3 187 337 | A1 | 7/2017 |
| JP | 04-365384 | A | 12/1992 |
| JP | 2001-503920 | A | 3/2001 |

(Continued)

OTHER PUBLICATIONS

Extended European Search Report for Application No. EP 17 17 9405 dated Dec. 15, 2017 (8 pages).

*Primary Examiner* — Geoffrey Mruk
(74) *Attorney, Agent, or Firm* — Harness, Dickey & Pierce, P.L.C.

(57) ABSTRACT

A fluid ejection device is provided with a valving element adapted to reciprocate in the containing chamber to thereby push the fluid out from the ejection port, and then block the ejection port with a tip part. The containing chamber is provided with a communication port for accepting the fluid pressure-fed from a supply section. In the case in which the valving element is located at a predetermined stopping position, a internal space of the containing chamber is divided by a boundary part, which is formed of a part of the valving element and a part of the containing chamber having contact with each other, into a first space including a part of the space between the ejection port and the communication port, and a second space in which the communication port opens.

3 Claims, 8 Drawing Sheets

(56) References Cited

U.S. PATENT DOCUMENTS

| | | | | |
|---|---|---|---|---|
| 2012/0312838 | A1* | 12/2012 | Clark | B05C 5/0225 222/146.5 |
| 2015/0233334 | A1 | 8/2015 | Miyamoto et al. | |

FOREIGN PATENT DOCUMENTS

| | | | | | |
|---|---|---|---|---|---|
| JP | 2013-184451 | A | | 9/2013 | |
| WO | WO 94/08794 | | * | 4/1994 | B41J 2/14 |
| WO | WO-94-008794 | A1 | | 4/1994 | |
| WO | WO-1998-021759 | A1 | | 5/1998 | |
| WO | WO-2008-146464 | A1 | | 12/2008 | |
| WO | WO-2015-065607 | A1 | | 5/2015 | |
| WO | WO-2016-030566 | A1 | | 3/2016 | |

* cited by examiner

FLUID EJECTION DEVICE

BACKGROUND

1. Technical Field

The present invention relates to a fluid ejection device.

2. Related Art

In the past, there have been proposed a variety of fluid ejection device for ejecting a fluid from an ejection port. For example, in the brochure of International Publication No. WO 2008/146464 (Document 1) mentioned below, there is disclosed a jet-type ejection device for reciprocating a plunger rod as a valving element in a liquid chamber as a containing chamber to extrude a liquid from a liquid chamber outlet port as an ejection port to thereby eject the liquid as a droplet. The ejection mechanism of a fluid using a reciprocating operation of such a valving element as in Document 1 is applied to an inkjet printer for ejecting ink to manufacture a printed matter, or a 3D printer for ejecting a liquid material to shape a three-dimensional article in some cases.

In such a projection mechanism of a fluid as described in Document described above, in order to shorten the period of repeatedly ejecting the fluid, the containing chamber is normally kept high in pressure by pressure-feeding the fluid into the containing chamber. However, if the blocking state of the ejection port by the valving element is deteriorated to cause a gap, the fluid leaks through the gap in some cases due to the pressure even if the gap is as minute as approximately 1 μm. There is a period in which the ejection of the fluid is not performed such as a period of a standby state in which the drive of the valving element is halted, and the longer the period is, the more the possibility, that such leakage of the fluid from the ejection port caused by the pressure in the containing chamber occurs, is increased. The leakage of the fluid from the ejection port leads to waste of the fluid. Further, in the case in which the fluid as the ejection object is, for example, a liquid or a fluent material high in viscosity, the fluid having leaked from the ejection port adheres to a circumferential edge part of the ejection port to exert a negative influence on the subsequent ejection of the fluid to cause ejection failure in some cases.

As described above, in the field of the art of the fluid ejection device, there still remains a room for improving the technology of preventing such leakage of the fluid from the ejection port. Such a problem is common to the inkjet printer and the 3D printer as an aspect of the fluid ejection device. In particular in the 3D printer, on the ground that the liquid material high in viscosity including powder material is used, there is a significant demand for generating higher pressure in the containing chamber and preventing the leakage of the liquid material from the ejection port, in general.

SUMMARY

An advantage of some aspects of the invention is to solve at least a part of the problems described above, and the invention can be implemented as the following forms.

[1] According to an aspect of the invention, a fluid ejection device is provided. The fluid ejection device according to this aspect of the invention ejects a fluid contained in a containing chamber from an ejection port provided to the containing chamber. The fluid ejection device according to this aspect of the invention is provided with a valving element. The valving element reciprocates in the containing chamber toward the ejection port to thereby push the fluid out from the ejection port, and then block the ejection port with a tip part. The containing chamber is provided with a communication port, which is adapted to accept the fluid pressure-fed from a supply section, disposed at a position separated from the ejection port in a direction from the ejection port toward the valving element. The valving element stops at a predetermined stopping position when the ejection of the fluid from the ejection port is not performed. In the case in which the valving element is located at the stopping position, an internal space of the containing chamber is divided by a boundary part, which is formed by a part of the valving element and a part of the containing chamber having contact with each other, into a first space including a part of a space between the ejection port and the communication port, and a second space in which the communication port opens, and in the case in which the valving element is displaced from the stopping position, the division by the boundary part is released to make the first space and the second space communicated with each other.

According to the fluid ejection device of this aspect of the invention, the boundary part formed when the valving element stops blocks the communication between the first space located on the ejection port side and the second space including the communication port. Thus, the pressure of the fluid pressure-fed from the communication port is prevented from being transferred to the first space, and thus, the leakage of the fluid from the ejection port is prevented.

[2] In the fluid ejection device according to the aspect of the invention, the stopping position may be a position where the tip part of the valving element blocks the ejection port, the valving element may have a valving element flaring part, which is located in a region on a back-end part side of a contact region having contact with a circumferential edge part of the ejection port when blocking the ejection port, and flares to outside of the contact region throughout an outer circumference of the valving element when viewing the valving element from the tip part side along a direction of the reciprocation, an inner wall surface of the containing chamber may include a containing chamber flaring part, which is located between the communication port and the ejection port in the direction of the reciprocation, and surrounds the ejection port and flares toward the ejection port to a position overlapping the valving element flaring part when viewed from the back-end part side of the valving element along the direction of the reciprocation, and the valving element flaring part and the containing chamber flaring part may have contact with each other to form the boundary part in a case in which the valving element is located at the stopping position. According to the fluid ejection device of this aspect of the invention, when the valving element blocks the ejection port, the valving element flaring part and the containing chamber flaring part have contact with each other to block the communication between the first space and the second space. Therefore, even if the ejection port is not in the state of being completely blocked, the leakage of the fluid from the ejection port is prevented.

[3] In the fluid ejection device according to the aspect of the invention, a resin member adapted to form a sealing line in the boundary part may be provided to at least one of the valving element flaring part and the containing chamber flaring part. According to the fluid ejection device of this aspect of the invention, since the sealing performance of the boundary part between the first space and the second space is improved, the leakage of the fluid from the ejection port is further prevented.

[4] In the fluid ejection device according to the aspect of the invention, the stopping position may be a position where the tip part of the valving element may be the furthest from the ejection port, the inner wall surface of the containing chamber may include a first flaring part, which is located between the communication port and the ejection port, and surrounds an outer circumference of the valving element, and flares toward the ejection port when viewed from the tip part side of the valving element along the direction of the reciprocation, the valving element may include a second flaring part, which is located in a region on the tip part side of a passing region passing through an area surrounded by the first flaring part during the reciprocation, and flares to outside of the passing region throughout an outer circumference of the valving element to overlap the first flaring part when viewed from the back-end part side of the valving element along the direction of the reciprocation, and the first flaring part and the second flaring part may have contact with each other to form the boundary part in a case in which the valving element is located at the stopping position. According to the fluid ejection device of this aspect of the invention, in the case in which the valving element is located at the furthest position from the ejection port, the first flaring part and the second flaring part have contact with each other to spatially divide the first space and the second space from each other. Since the first space is in the state in which the regions other than the ejection port are sealed, the fluid contained in the first space is kept in the first space without leaking from the ejection port. Therefore, the leakage of the fluid from the ejection port is prevented.

[5] In the fluid ejection device according to the aspect of the invention, a resin member adapted to form a sealing line in the boundary part may be provided to at least one of the first flaring part and the second flaring part. According to the fluid ejection device of this aspect of the invention, since the sealing performance of the boundary part between the first space and the second space is improved, the leakage of the fluid from the ejection port is further prevented.

[6] In the fluid ejection device according to the aspect of the invention, the stopping position may be a position where the tip part of the valving element blocks the ejection port, an inner wall surface of the containing chamber may include a projection part located at a position separated from the ejection port in a direction from the ejection port toward the valving element, surrounds the ejection port, and projects toward the ejection port, the tip part may pass through an area surrounded by the projection part in a case in which the valving element reciprocates, and an inner circumferential surface of the projection part may have contact with an outer circumferential side surface of the valving element to form the boundary part in a case in which the valving element is located at the stopping position. According to the fluid ejection device of this aspect of the invention, since the first space and the second space are spatially divided from each other by the inner circumferential surface of the projection part touching the outer circumferential side surface of the valving element, and therefore, the leakage of the fluid from the ejection port is prevented.

All of the constituents provided to each of the aspects of the invention described above are not necessarily essential, and in order to solve all or a part of the problems described above, or in order to achieve all or a part of the advantages described in the specification, it is possible to arbitrarily make modifications, eliminations, replacement with another new constituent, partial deletion of restriction content on some of the constituents. Further, in order to solve all or a part of the problems described above, or in order to achieve all or a part of the advantages described in the specification, it is also possible to combine some or all of the technical features included in one of the aspects of the invention with some or all of the technical features included in another of the aspects of the invention to thereby form an independent aspect of the invention.

The invention can be implemented in a variety of forms other than the fluid ejection device. The invention can be implemented in the form of, for example, an ejection mechanism of the fluid, a liquid ejection device for ejecting a liquid from the ejection port, a three-dimensional article shaping device for ejecting a fluid material to manufacture a three-dimensional article, an image forming device for ejecting ink to form an image, and a printing device.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
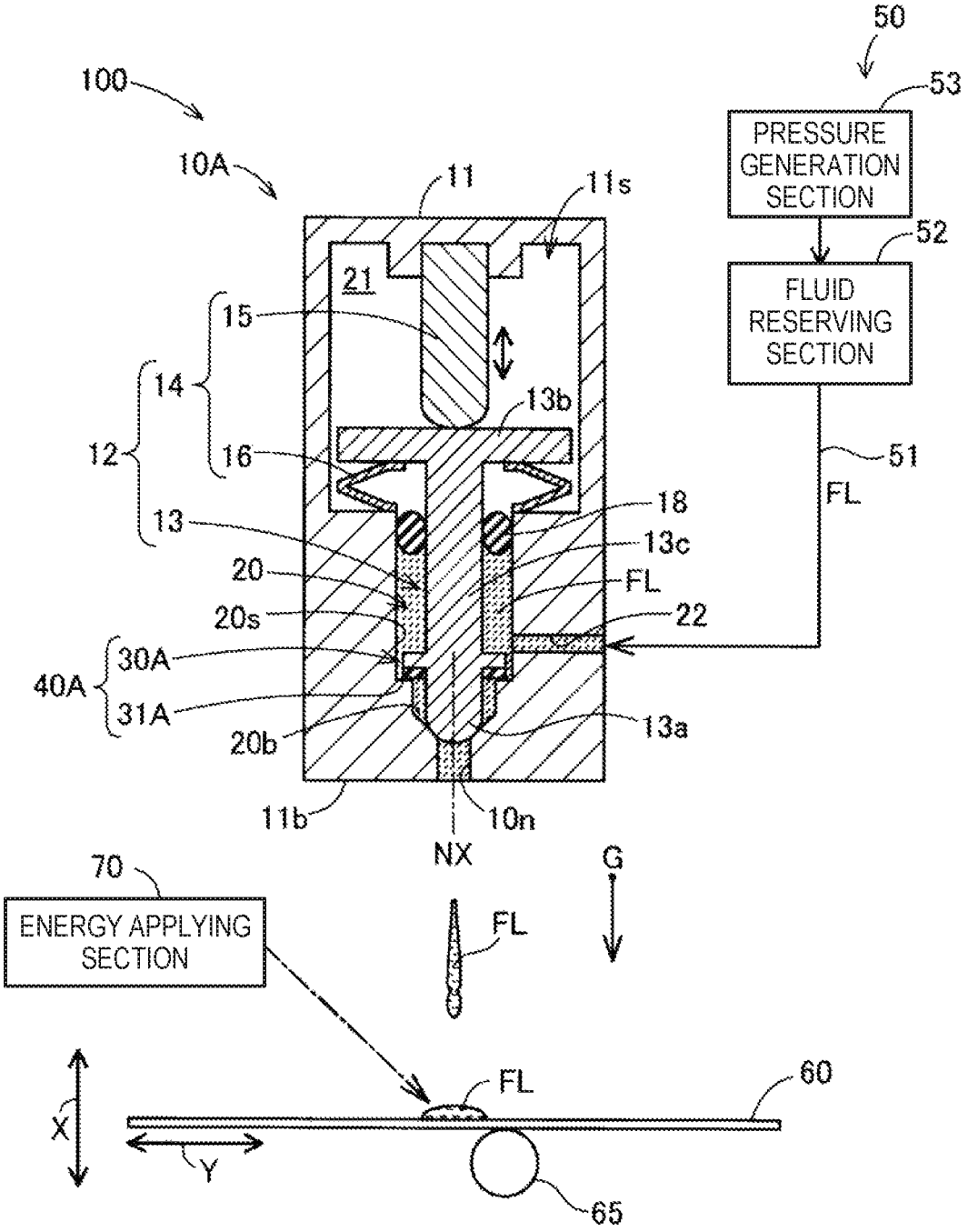
FIG. 1 is a schematic diagram showing a configuration of a fluid ejection device according to a first embodiment of the invention.

FIG. 1 is a schematic diagram showing a configuration of a fluid ejection device 100 according to a first embodiment of the invention. In FIG. 1, there is illustrated an arrow G showing a gravitational direction (a vertical direction) when the fluid ejection device 100 is used in a normal usage state. In the present specification, "upper" and "lower" denote the directions based on the vertical direction.

The fluid ejection device 100 according to the present embodiment ejects a fluid FL from an ejection port 10*n* as a nozzle of an ejection section 10A. In the present embodiment, "ejection" denotes an action of applying pressure to the fluid reserved in a containing space to discharge the fluid from the containing space to the outside via an opening part.

Therefore, in the case of "ejecting" a liquid, the configuration includes a configuration of discharging the liquid in a droplet state, in a liquid column state, or a misty state, and also includes a configuration of discharging the liquidby spray. The fluid ejection device 100 ejects the fluid LF as a droplet.

The fluid ejection device 100 is a so-called a 3D printer, and ejects the fluid FL as a liquid material from the ejection section 10A on a shaping stage 60. A specific example of the fluid FL will be described later. The fluid ejection device 100 stacks layers each formed by solidifying the fluid FL on the shaping stage 60 to thereby manufacture a three-dimensional article. The fluid ejection device 100 is provided with a supply section 50, a moving mechanism 65, and an energy applying section 70 in addition to the ejection section 10A and the shaping stage 60.

The ejection section 10A is a so-called head part, and is provided with a housing section 11 as a hollow container, and an ejection mechanism 12 for ejecting the fluid FL. In the present embodiment, the housing section 11 has a roughly cylindrical shape, and is formed of, for example, stainless steel. The bottom surface 11*b* of the housing section 11 is provided with the ejection port 10*n* described above formed as a through hole communicated with an internal space 11*s* of the housing section 11. The ejection mechanism 12 is housed in the internal space 11*s* of the housing section 11. The ejection mechanism 12 is provided with a valving element 13 and a drive section 14. The drive section 14 is provided with a piezo element 15 as a piezoelectric element, and a biasing member 16.

The valving element 13 reciprocates in a direction along the central axis of the valving element 13, namely along the direction from the tip part 13*a* of the valving element 13 toward the back-end part 13*b* thereof. In the present embodiment, the tip part 13*a* is disposed on the lower side, the back-end part 13*b* is disposed on the upper side, and the valving element 13 reciprocates along the vertical direction. In the present embodiment, the valving element 13 is formed of a columnar member made of metal. In the present embodiment, the tip part 13*a* has a hemispherical shape, and the back-end part 13*b* has a roughly disk-like shape extending from the central axis of the valving element 13 in horizontal directions.

A region between the tip part 13*a* and the back-end part 13*b* of the valving element 13 is called a "main body part 13*c*." In the present embodiment, the main body part 13*c* has a roughly circular cylindrical shape. The main body part 13*c* is provided with a valving element flaring part 30A locally flaring outward throughout the circumference of the valving element 13. The valving element flaring part 30A will be described later. In the present embodiment, the diameter of the main body part 13*c* in the region other than the valving element flaring part 30A can be, for example, approximately 2 through 5 mm.

The valving element 13 is disposed so that the central axis of the valving element 13 coincides with the central axis NX of the ejection port 10*n*, and reciprocates on the central axis NX of the ejection port 10*n*. The valving element 13 reciprocates toward the ejection port 10*n*. When the valving element 13 is displaced to the lowermost position, the tip part 13*a* touches the circumferential edge part of the opening of the ejection port 10*n* to block the ejection port 10*n*. In the projection section 10A, due to the piston action, namely the reciprocation of the valving element 13, the fluid FL is ejected from the ejection port 10*n* (described later in detail).

The main body part 13*c* of the valving element 13 is inserted through the through hole located at the center of a sealing member 18 having a ring-like shape formed of an O-ring made of resin. The sealing member 18 is disposed so as to airtightly have contact with the outer circumferential surface in the main body part 13*c* of the valving element 13 and the inner wall surface of the internal space 11*s* of the housing section 11 around the central region in the vertical direction of the housing section 11. Thus, the internal space 11*s* of the housing section 11 is sectioned into a containing chamber 20 and a driving chamber 21 across the sealing member 18.

The containing chamber 20 is located on the lower side of the housing section 11. The ejection port 10*n* is communicated with the containing chamber 20. The bottom surface 20*b* of the containing chamber 20 forms a tilted wall surface tapered toward the center of the bottom surface 20*b*, and the ejection port 10*n* is disposed at the lowermost region at the center of the bottom surface 10*b* as a trough hole penetrating in the vertical direction. The angle formed between the parts of the bottom surface 20*b* opposed to each other across the ejection port 10*n* can be approximately 90°. In the present embodiment, the ejection direction, namely the direction in which the fluid FL is ejected from the ejection port 10*n*, is the vertical direction as the opening direction of the ejection port 10*n*. The opening diameter of the ejection port 10*n* can be, for example, in a range of approximately 40 through 60 μm. The length in the vertical direction of the ejection port 10*n* can be set to, for example, in a range of approximately 10 through 30 μm.

The containing chamber 20 contains the fluid FL. The containing chamber 20 is provided with a communication port 22 for accepting the fluid FL pressure-fed from the supply section 50. The communication port 22 is located above the ejection port 10*n*, and is disposed at a position separated from the ejection port 10*n* in the direction from the tip part 13*a* toward the back-end part 13*b* of the valving element 13. In the present embodiment, the communication port 22 penetrates the wall part of the housing section 11 in a horizontal direction, and is communicated with the containing chamber 20. The opening diameter of the communication port 22 can be set to, for example, in a range of approximately 0.5 through 2 mm.

The containing chamber 20 is provided with a containing chamber flaring part 31A corresponding to the valving element flaring part 30A of the valving element 13. The containing chamber flaring part 31A will be described later.

The containing chamber 20 is located on the upper side of the housing section 11. In the driving chamber 21, there is disposed the back-end part 13*b* of the valving element 13. Further, in the driving chamber 21, there are disposed the piezo element 15 constituting the drive section 14 described above, and the biasing member 16. The drive section 14 generates the driving force for reciprocating the valving element 13.

The piezo element 15 has a configuration in which a plurality of piezoelectric materials stacked one another, and the length thereof changes in the stacking direction due to application of a voltage to each of the piezoelectric materials. The upper end part of the piezo element 15 is fixed to the upper wall surface of the driving chamber 21, and the lower end part thereof has contact with the back-end part 13*b* of the valving element 13. By the piezo element 15 extending to apply a load, the valving element 13 is displaced downward.

It is sufficient for the load to be applied to the piezo element 15 when the valving element 13 is displaced downward to be determined in accordance with the target pressure caused in the fluid FL in the ejection port 10*n* when ejecting the fluid FL from the ejection port 10*n*. For example, in the case in which the target pressure is in a range of approximately 900 through 1100 MPa, the load to be applied by the piezo element 15 to the valving element 13 can be set to approximately several hundreds of Newtons.

The biasing member 16 biases the valving element 13 upward. In the present embodiment, the biasing member 16 is formed of a disc spring, disposed on the lower side of the back-end part 13*b* of the valving element 13 so as to surround the periphery of the main body part 13*c*, and applies force to the back-end part 13*b*.

In the state in which the piezo element 15 extends to the maximum length, the tip part 13*a* of the valving element 13 has airtight line contact with the tilted wall surface of the circumferential edge part of the ejection port 10*n* to block the ejection port 10*n*. When the piezo element 15 contracts, the valving element 13 is displaced upward following the lower end part of the piezo element 15 due to the biasing force of the biasing member 16, and the tip part 13*a* thereof is detached from the ejection port 10*n*.

As described above, by the valving element 13 reciprocating between the position of blocking the ejection port 10*n* and the position of being detached from the ejection port 10*n*, the ejection port 10*n* is opened and closed. In the present embodiment, the valving element 13 is displaced in a range of approximately 40 through 60 mm. The ejection mechanism of the fluid FL due to the reciprocal motion of the valving element 13 will be described later.

The supply section 50 pressure-feeds the fluid FL to the containing chamber 20 of the ejection section 10A via the communication port 22. The supply section 50 is provided with a pipe 51, a fluid reserving section 52, and a pressure generation section 53. The pipe 51 connects the communication port 22 and the fluid reserving section 52 to each other. The fluid reserving section 52 is formed of a tank for reserving the fluid FL, and functions as a supply source of the fluid FL in the fluid ejection device 100. In the fluid reserving section 52, the fluid FL is mixed with a solvent to be adjusted so that the fluid FL is kept in a predetermined viscosity (the detailed description is omitted). The viscosity of the fluid FL can be, for example, approximately 20,000 mPa·s.

The pressure generation section 53 is formed of, for example, a pressure pump. The pressure generation section 53 applies the pressure for flowing into the containing chamber 20 via the pipe 51 to the fluid FL in the fluid reserving section 52. The pressure generation section 53 applies the pressure of, for example, in a range of approximately 0.4 through 0.6 MPa to the fluid FL. It should be noted that although in FIG. 1, the pressure generation section 53 is disposed on the upstream side of the fluid reserving section 52, the pressure generation section 53 can be dispose on the downstream side of the fluid reserving section 52.

The shaping stage 60 is disposed in front of the ejection port 10*n* in the opening direction. The shaping stage 60 is formed of a flat plate-like member, and is disposed roughly horizontally. The shaping stage 60 is disposed at, for example, a position distant as much as in a range of approximately 1.5 through 3 mm vertically downward from the ejection port 10*n*. In the fluid ejection device 100 according to the present embodiment, the shaping stage 60 is changed in the position relatively to the ejection port 10*n* of the ejection section 10A due to the moving mechanism 65.

The moving mechanism 65 is provided with a motor, a roller, a shaft, a variety of types of actuator, and so on for moving the shaping stage 60. As indicated by both of the arrows X, Y, the moving mechanism 65 displace the shaping stage 60 in the horizontal direction and the vertical direction relatively to the ejection section 10A. Thus, the landing position of the fluid FL on the shaping stage 60 is adjusted. It should be noted that in the fluid ejection device 100, it is possible to adopt a configuration in which the shaping stage is fixed, and the ejection section 10A is displaced relatively to the shaping stage 60.

The energy applying section 70 applies energy to the fluid FL having landed on the shaping stage 60 to make the fluid cure. In the present embodiment, the energy applying section 70 is formed of a laser device, and applies optical energy to the droplet by irradiation with the laser. The energy applying section 70 includes at least a laser source, a condenser lens for converging the laser emitted from the laser source to the droplet landed on the shaping stage 60, and a galvanometer mirror for performing scanning with the laser (not shown). The energy applying section 70 scans the landing position of the droplet on the shaping stage 60 with the laser to sinter the material powder in the droplet with the optical energy of the laser. Alternatively, the energy applying section 70 once melts the material powder in the droplet, and then solidifies the material powder thus melted. Thus, the particles constituting the three-dimensional article as the manufacturing object or a support part for supporting the three-dimensional article are fixed on the shaping stage 60.

Due to the configuration described above, the fluid ejection device 100 according to the present embodiment ejects the fluid FL from the ejection section 10A toward the shaping stage 60 to thereby manufacture the three-dimensional article. The fluid FL as a liquid material used in the present embodiment is a fluent composition including the powder and the solvent. The liquid material can also be a mixed material including a simplicial powder of, for example, magnesium (Mg), iron (Fe), cobalt (Co), chromium (Cr), aluminum (Al), titanium (Ti), copper (Cu), and nickel (Ni), or a mixed powder of an alloy (e.g., maraging steel, stainless steel, cobalt-chromium-molybdenum, titanium alloy, nickel alloy, aluminum alloy, cobalt alloy, and cobalt-chrome alloy) including one more of these metals and so on, a solvent, and binder, and processed to a slurry or a paste. Further, the liquid material can also be a molten material made of resin such as general-purpose engineering plastic such as polyamide, polyacetal, polycarbonate, modified polyphenylene ether, polybutylene terephthalate, or polyethylene terephthalate. Besides the above, the liquid material can also be resin such as engineering plastic such as polysulfone, polyether sulfone, polyphenylene sulfide, polyarylate, polyimide, polyamide-imide, polyetherimide, or polyether ether ketone. As described above, the liquid material is not particularly limited, metals, ceramics, resin other than those described above can also be used. The solvent of the liquid material can be, for example, water, a (poly) alkylene glycol monoalkyl ether group such as ethylene glycol monomethyl ether, ethylene glycol monoethyl ether, propylene glycol monomethyl ether, or propylene glycol monoethyl ether, an ester acetate group such as ethyl acetate, n-propyl acetate, isopropyl acetate, n-butyl acetate, or isobutyl acetate, an aromatic hydrocarbon group such as benzene, toluene, or xylene, a ketone group such as methyl ethyl ketone, acetone, methyl isobutyl ketone, ethyl-n-butyl ketone, diisopropyl ketone, acethylacetone, an alcohol group such as ethanol, propanol, or butanol, a tetraalkylammonium acetate group, a sulfoxide series solvent such as dimethyl sulfoxide, or diethyl sufoxide, a pyridine series solvent such as pyridine, γ-picoline, or 2,6-lutidine, an ionic liquid such as tetraalkylammonium acetate (e.g., tetrabutylammonium acetate), or one species or a combination of two or more species selected from these compounds. Further, the binder can be, for example, acrylic resin, epoxy resin, silicone resin, cellulosic resin, or other synthetic resin, polylactic acid (PLA), polyamide (PA), polyphenylene sulfide (PPS) or other thermoplastic resin.

Figure 2:
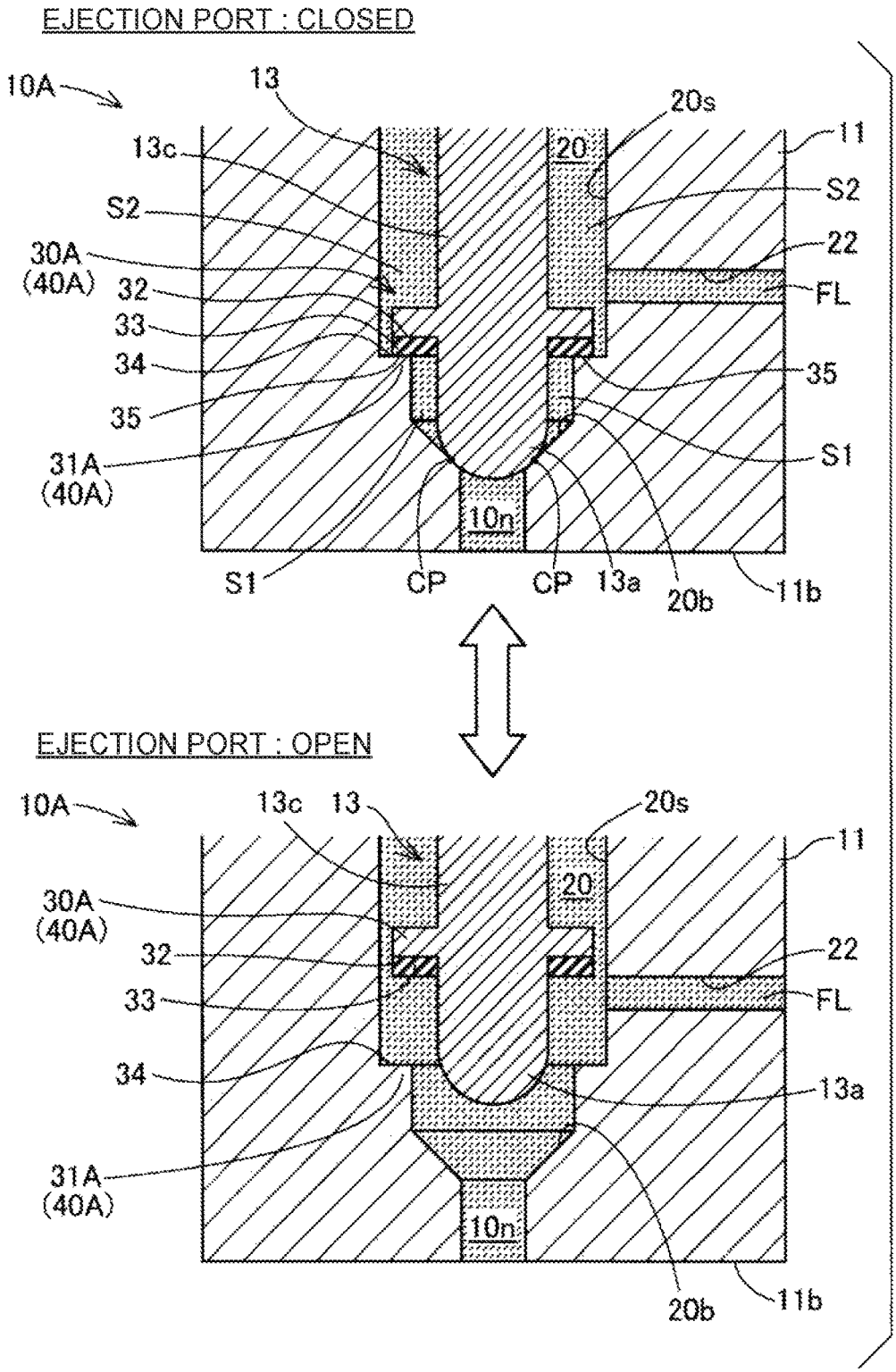
FIG. 2 is a schematic diagram for explaining a configuration of a fluid ejection mechanism in an ejection section and a dividing mechanism according to the first embodiment.

FIG. 2 is a schematic diagram for explaining the ejection mechanism of the fluid FL in the ejection section 10A and a configuration of a dividing mechanism 40A according to the first embodiment. An upper part and a lower part of FIG. 2 each show the internal structure in the vicinity of the containing chamber 20 of the ejection section 10A. The upper part of FIG. 2 shows the state in which the tip part 13*a* of the valving element 13 touches the circumferential edge part of the ejection port 10*n* to block the ejection port 10*n*. The lower part of FIG. 2 shows the state in which the tip part 13*a* of the valving element 13 is detached from the ejection port 10*n* to open the ejection port 10*n*.

In the ejection section 10A, ejection of the fluid FL from the ejection section 10A is performed in the following manner. Before the ejection of the fluid FL, the ejection section 10A is in the state in which the piezo element 15 extends to make the valving element 13 block the ejection port 10*n* (the upper part of FIG. 2). Further, the pressure in the containing chamber 20 is raised to predetermined pressure due to the pressure-feed of the fluid FL by the supply section 50.

When starting the ejection of the fluid FL, firstly, the piezo element 15 contracts to displace the valving element 13 upward, and thus, the tip part 13*a* thereof is detached from the ejection port 10*n* (the lower part of FIG. 2). On this occasion, using the pressure applied to the fluid FL as the driving force, the fluid FL flows into an area between the valving element 13 and the ejection port 10*n* in the containing chamber 20.

The contraction state of the piezo element 15 is kept for a predetermined minute period, and then the piezo element 15 deforms to extend, and thus, the valving element 13 is displaced toward the ejection port 10*n* (the upper part of FIG. 2). Thus, the fluid FL having flown into the area between the valving element 13 and the ejection port 10*n* is pushed out to the outside via the ejection port 10*n*, and then the fluid FL hangs downward from the ejection port 10*n*. When the ejection port 10*n* is completely blocked by the valving element 13, the flow of the fluid FL from the ejection port 10*n* is blocked, and the fluid FL having hanged from the ejection port 10*n* drops downward as a droplet. In the fluid ejection device 100, when manufacturing the three-dimensional article, the unit ejection action in which the valving element 13 makes a stroke from the position where the valving element 13 blocks the ejection port 10*n* is repeated normally at intervals of several hundreds of milliseconds.

Here, in the fluid ejection device 100, in the case in which the ejection of the fluid FL is not performed, the valving element 13 stops at a predetermined stopping position. The "case in which the ejection of the fluid FL is not performed" denotes at least a period in which a drive signal for ejecting the fluid FL is not output to the piezo element 15 of the ejection section 10A during the period of driving to operate the fluid ejection device 100. Further, the "stoppage" of the valving element 13 denotes the state in which the speed of the valving element is 0. In the present embodiment, as described above, when the unit ejection action is completed, the valving element 13 stops at the position of blocking the ejection port 10*n*. In the configuration of the present embodiment, it is possible to interpret that the "case in which the ejection of the fluid FL is not performed" described above includes a period between two consecutive ejection actions in the period in which the ejection action is continuously repeated.

In the present embodiment, the stopping position of the valving element 13 is the position where the tip part 13*a* of the valving element 13 blocks the ejection port 10*n*. Thus, the ejection port 10*n* is blocked by the valving element 13 to prevent the fluid FL from flowing from the ejection port 10*n* in the period in which the ejection of the fluid FL is not performed. Further, in the present embodiment, due to the dividing mechanism 40A described below disposed in the containing chamber 20 described below, the leakage of the fluid FL from the ejection port 10*n* is prevented. In the present embodiment, the dividing mechanism 40A is constituted by the valving element flaring part 30A provided to the valving element 13, and the containing chamber flaring part 31A forming a part of the inner wall surface 20*s* of the containing chamber 20.

The valving element flaring part 30A is formed as a region having a flange-like shape locally projecting in the radial direction of the valving element 13 in the main body part 13*c*. The "radial direction of the valving element 13" is a direction perpendicular to the direction along the central axis of the valving element 13. In the present embodiment, the radial direction of the main body part 13*c* coincides with the horizontal direction. The valving element flaring part 30A has an opposed surface 32 opposed to the containing chamber flaring part 31A in the direction of the reciprocation of the valving element 13. The opposed surface 32 in the valving flaring part 30A in the present embodiment is roughly horizontal surface facing downward surrounding the outer periphery of the main body part 13*c*.

The valving element flaring part 30A is disposed in a region located on the back-end part 13*b* side of a contact region CP in the tip part 13*a* having contact with the circumferential edge part of the ejection port 10*n* when blocking the ejection port 10*n* (the upper part of FIG. 2). The valving element flaring part 30A flares to the outside of the contact region CP throughout the outer circumference of the valving element 13 when viewing the valving element 13 from the tip part 13*a* side along the direction of the reciprocation. It should be noted that the valving element flaring part 30A is formed so as to have a certain gap with the inner wall surface 20*s* of the containing chamber 20 in the state in which the valving element 13 opens the ejection port 10*n* so that the fluid FL flows into the area located above the valving flaring part 30A.

The valving element flaring part 30A of the present embodiment has a resin member 33 for forming a sealing line on the opposed surface 32. In the present embodiment, the resin member 33 is configured as a coating type sealing member, and is formed of a resin material having elasticity such as rubber or other elastomer. When the reciprocation of the valving element 13 is repeated, impact force is repeatedly applied to the resin member 33 as a result, and therefore, in order to improve the durability, it is desirable for the resin member 33 to have a thickness in a range of, for example, approximately 10 through 30 μm.

The containing chamber flaring part 31A according to the present embodiment is formed as a step part having a roughly horizontal step surface 34 facing to the valving element flaring part 30A of the valving element 13. The containing chamber flaring part 31A is disposed between the communication port 22 and the ejection port 10*n* in the direction of the reciprocation of the valving element 13. The containing chamber flaring part 31A surrounds the outer circumference of the ejection port 10*n* when viewed from the back-end part 13*b* side of the valving element 13 along the direction of the reciprocation of the valving element 13, and flares toward the ejection port 10*n* to a position overlapping the valving element flaring part 30A.

When the valving element 13 is located at the stopping position (the upper part of FIG. 2), the valving element flaring part 30A has contact with the step surface 34 of the containing chamber flaring part 31A in the resin member 33 disposed on the opposed surface 32. Thus, the valving element flaring part 30A and the containing chamber flaring part 31A form a boundary part 35 for spatially dividing the containing chamber 20 into a first space S1 including a part of the space between the ejection port 10*n* and the communication port 22, and a second space S2 to which the communication port 22 opens. "Spatially dividing" means the state in which the communication state between the two spaces is substantially blocked. When the valving element 13 is displaced from the stopping position, the division by the boundary part 35 is released, and the first space S1 and the second space S2 are restored to the state of being communicated with each other.

As described above, in the fluid ejection device 100 according to the present embodiment, when the valving element 13 is located at the stopping position, the containing chamber 20 is spatially divided by the boundary part 35 into the first space S1 and the second space S2. Thus, between the containing chamber 20 and the ejection port 10*n*, there is formed a double sealing structure for preventing the leakage of the fluid FL using the contact region CP between the valving element 13 and the circumferential edge part of the ejection port 10*n*, and the boundary part 35 where the valving element flaring part 30A and the containing chamber flaring part 31A have contact with each other. Therefore, even if a gap occurs between the valving element 13 and the ejection port 10*n*, it is prevented that the fluid is pushed out to leak from the gap due to the pressure applied from the supply section 50 to the containing chamber 20 via the communication port 22.

Since the leakage of the fluid FL from the ejection port 10*n* is prevented, it is prevented that the fluid FL having leaked and adhered to the periphery of the ejection port 10*n* hinders the subsequent ejection of the fluid FL, and thus, the execution of the ejection process is smoothed. According to the fluid ejection device 100 of the present embodiment, the leakage of the fluid FL is prevented in the standby period in which the ejection of the fluid FL is not performed for a predetermined period equal to or longer than, for example, several seconds. Therefore, the trouble of executing a maintenance process such as flashing, namely idle ejection of the droplets, or cleaning of the ejection port 10*n* after the standby period can be omitted, which is efficient.

In the fluid ejection device 100 according to the present embodiment, since the containing chamber 20 is automatically divided into the first space S1 and the second space S2 in accordance with the reciprocation of the valving element 13 due to the dividing mechanism 40A, which is efficient. In the fluid ejection device 100 according to the present embodiment, the valving element flaring part 30A is formed as a projection part on the outer circumferential side surface of the valving element 13, and the containing chamber flaring part 31A is formed as the step part of the inner wall surface of the containing chamber 20.

As described above, in the fluid ejection device 100 according to the present embodiment, the dividing mechanism 40A is disposed with a simple configuration, and in this regard, the fluid ejection device 100 is efficient.

In the present embodiment, as described above, since the resin member 33 is disposed on the boundary part 35, the boundary part 35 is provided with the sealing line. Therefore, the blocking performance between the first space S1 and the second space S2 is improved, and the leakage prevention effect of the fluid FL described above is further improved. It should be noted that the resin member 33 can be disposed on the step surface 34 of the containing chamber flaring part 31A instead of the opposed surface 32 of the valving element flaring part 30A, or can be disposed on both of the opposed surface 32 and the step surface 34.

The minute gap between the valving element 13 and the ejection port 10*n* described above occurs in the case in which, for example, deformation due to the aged deterioration occurs in the valving element 13 or the circumferential edge part of the ejection port 10*n*. Further, the minute gap also occurs in the case in which the material powder included in the fluid FL, or a foreign matter other than the material powder adheres between the valving element 13 and the ejection port 10*n*. According to the fluid ejection device 100 of the present embodiment, even in the state in which such a gap occurs, the ejection state from the ejection section 10A can be kept in good condition as described above. In this regard, the durability of the fluid ejection device 100 is improved. Further, the minute gap between the valving element 13 and the ejection port 10*n* occurs due to the manufacturing error when manufacturing the ejection section 10A in some cases. Therefore, according to the fluid ejection device 100 of the present embodiment, since the leakage of the fluid FL from such a gap is prevented as described above, the allowable range of the manufacturing error of the ejection section 10A can be expanded, and thus, the manufacturing cost of the fluid ejection device 100 can be reduced.

As described above, according to the fluid ejection device 100 of the present embodiment, the fluid is prevented by the dividing mechanism 40A disposed in the containing chamber 20 from leaking from the ejection port 10*n* when the fluid FL is not ejected. It should be noted that the variety of advantages described above can particularly remarkably be obtained in the configuration high in load applied to the valving element 13 and the ejection port 10*n* such as the configuration of ejecting the fluid FL high in viscosity and including a fine powder as in the case of the fluid ejection device 100 according to the present embodiment or a configuration of driving the valving element 13 at high speed.

B. Second Embodiment

Figure 3:
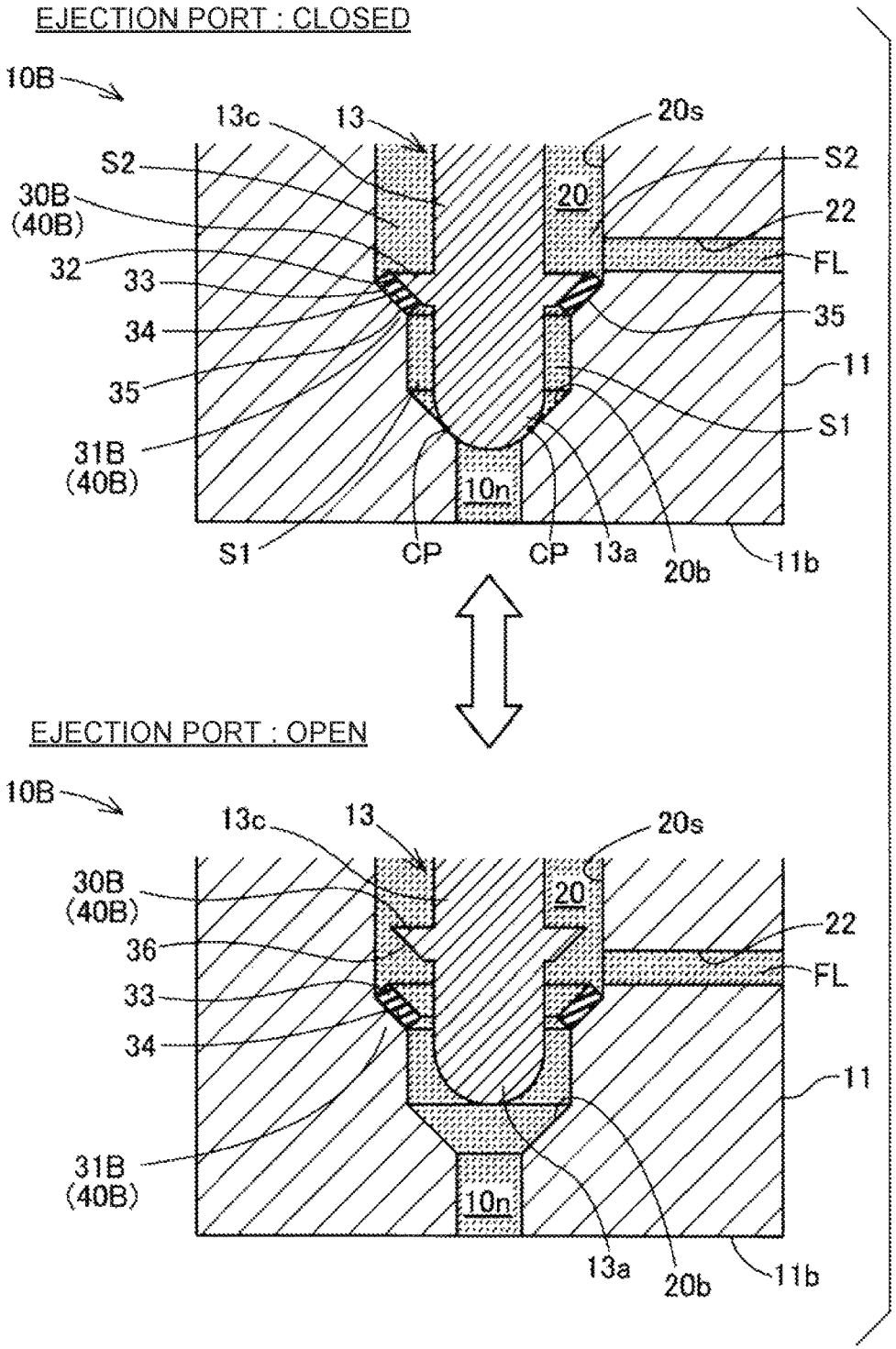
FIG. 3 is a schematic diagram for explaining a dividing mechanism according to a second embodiment of the invention.

FIG. 3 is a schematic diagram for explaining a dividing mechanism 40B disposed in an ejection section 10B provided to a fluid ejection device according to a second embodiment of the invention. In FIG. 3, the state in which the ejection port 10*n* is closed by the valving element 13 is shown in the upper part, and the state in which the ejection port 10*n* is opened is shown in the lower part. The fluid ejection device according to the second embodiment has substantially the same configuration as the fluid ejection device 100 (FIG. 1) according to the first embodiment except the point that the configuration of the dividing mechanism 40B disposed in the ejection section 10B is different.

The dividing mechanism 40B according to the second embodiment is constituted by a valving element flaring part 30B and a containing chamber flaring part 31B. The valving element flaring part 30B of the second embodiment is substantially the same as the valving element flaring part 30A of the first embodiment except the point that the opposed surface 32 opposed to the step surface 34 of the containing chamber flaring part 31B is formed of a tilted end surface in the radial direction of the valving element 13. The opposed surface 32 of the valving element flaring part 30B is tilted so as to face to the outer side of the valving element 13 and at the same tine face downward.

The containing chamber flaring part 31B of the second embodiment is substantially the same as the containing chamber flaring part 31A described in the first embodiment except the point that the step surface 34 is tilted so as to correspond to the opposed surface 32 of the valving element flaring part 30B. In the dividing mechanism 40B of the second embodiment, the resin member 33 is not disposed on the opposed surface 32 of the valving element flaring part 30B, but is disposed on the step surface 34 of the containing chamber flaring part 31B.

Also in the dividing mechanism 40B of the second embodiment, when the valving element 13 closes the ejection port 10*n*, the valving element flaring part 30B and the containing chamber flaring part 31B have contact with each other to form the boundary part 35 for dividing the containing chamber 20 into the first space S1 and the second space S2 (the upper part of FIG. 3). Therefore, as in the description of the first embodiment described above, it is prevented that the fluid FL leaks from the ejection port 10*n* when the ejection of the fluid FL is not performed. Further, according to the dividing mechanism 40B of the second embodiment, since the opposed surface 32 and the step surface 34 constituting the boundary part 35 are tilted with respect to the direction of the reciprocation of the valving element 13, a part of the impact force due to the contact between the valving element flaring part 30B and the containing chamber flaring part 31B can be released toward the direction crossing the direction of the reciprocation. Therefore, the deterioration due to the contact between the valving element flaring part 30B and the containing chamber flaring part 31B can be prevented. Besides the above, according to the dividing mechanism 40B of the second embodiment and the fluid ejection device equipped with the dividing mechanism 40B, a variety of functions and advantages substantially the same as those explained in the description of the first embodiment can be obtained.

C. Third Embodiment

Figure 4:
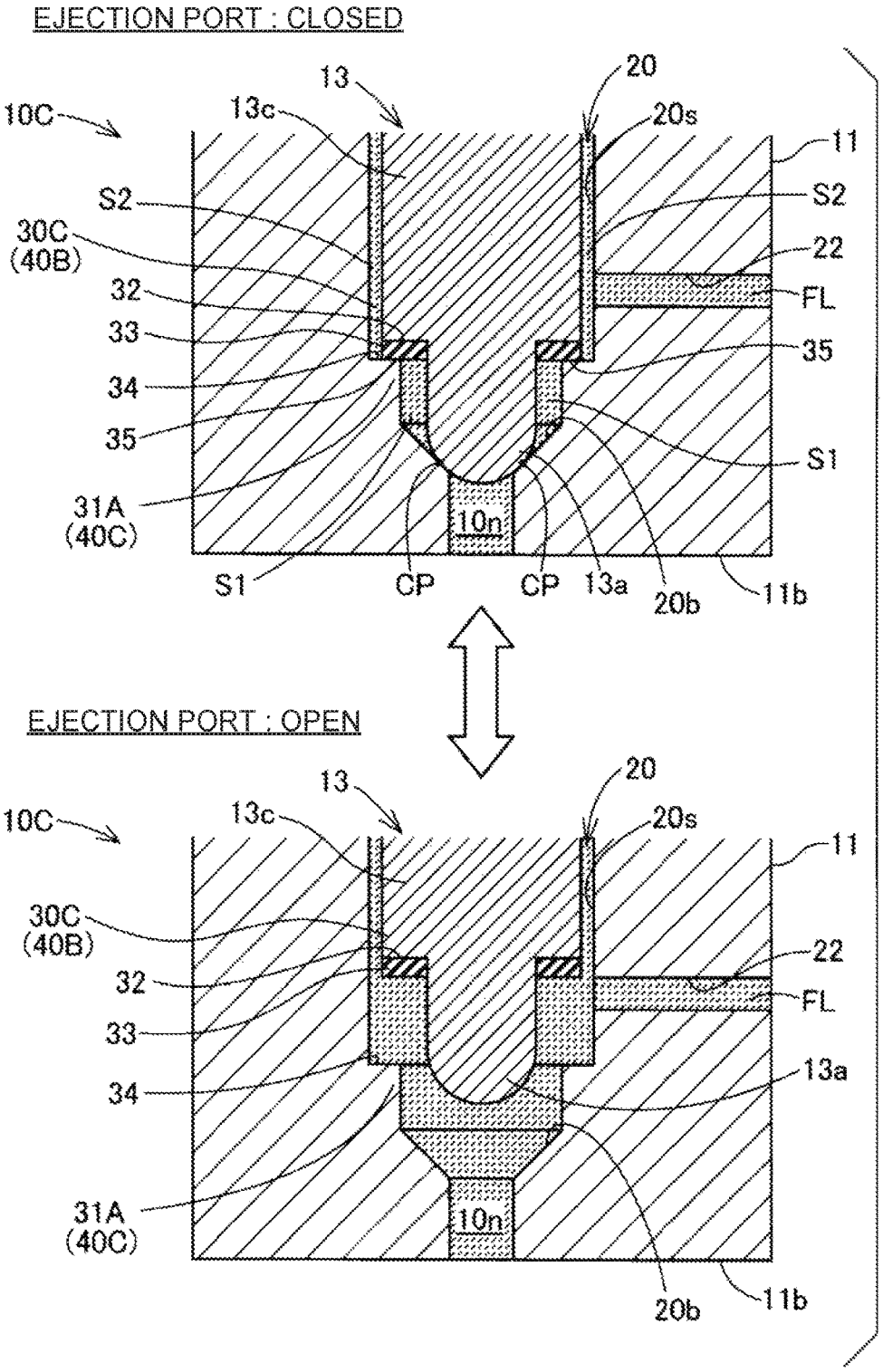
FIG. 4 is a schematic diagram for explaining a dividing mechanism according to a third embodiment of the invention.

FIG. 4 is a schematic diagram for explaining a dividing mechanism 40C disposed in an ejection section 10C provided to a fluid ejection device according to a third embodiment of the invention. In FIG. 4, the state in which the ejection port 10*n* is closed by the valving element 13 is shown in the upper part, and the state in which the ejection port 10*n* is opened is shown in the lower part. The fluid ejection device according to the third embodiment has substantially the same configuration as the fluid ejection device 100 (FIG. 1) according to the first embodiment except the point that the configuration of the dividing mechanism 40C disposed in the ejection section 10C is different.

The dividing mechanism 40C according to the third embodiment is constituted by a valving element flaring part 30C and the containing chamber flaring part 31A. The valving element flaring part 30C of the third embodiment is substantially the same as the valving element flaring part 30A of the first embodiment except the point that the valving element flaring part 30C is formed as a step part disposed on the outer circumferential side surface of the valving element 13, and the back-end part 13*b* side thereof is not reduced in diameter, and the surface on the opposite side to the opposed surface 32 is not provided. Similarly to the valving element flaring part 30A of the first embodiment, the valving element flaring part 30C has the roughly horizontal opposed surface 32. The containing chamber flaring part 31A of the third embodiment is substantially the same as the containing chamber flaring part 31A of the first embodiment.

Also in the dividing mechanism 40C of the third embodiment, when the valving element 13 closes the ejection port 10*n*, the valving element flaring part 30C and the containing chamber flaring part 31A have contact with each other to form the boundary part 35 for dividing the containing chamber 20 into the first space S1 and the second space S2 (the upper part of FIG. 4). Therefore, as in the description of the first embodiment described above, it is prevented that the fluid FL leaks from the ejection port 10*n* when the ejection of the fluid FL is not performed. According to the dividing mechanism 40C of the third embodiment, the strength of the valving element flaring part 30C is enhanced, and the damage such as breakage is prevented from occurring in the valving element flaring part 30C due to the contact with the containing chamber flaring part 31A. Besides the above, according to the dividing mechanism 40C of the third embodiment and the fluid ejection device equipped with the dividing mechanism 40C, a variety of functions and advantages substantially the same as those explained in the description of the first embodiment can be obtained. It should be noted that in the dividing mechanism 40C of the third embodiment, it is also possible to tilt the opposed surface 32 and the step surface 34 with respect to the direction of the reciprocation of the valving element 13 similarly to the description of the second embodiment. According to this configuration, substantially the same advantages as in the description of the second embodiment can be obtained.

D. Fourth Embodiment

Figure 5:
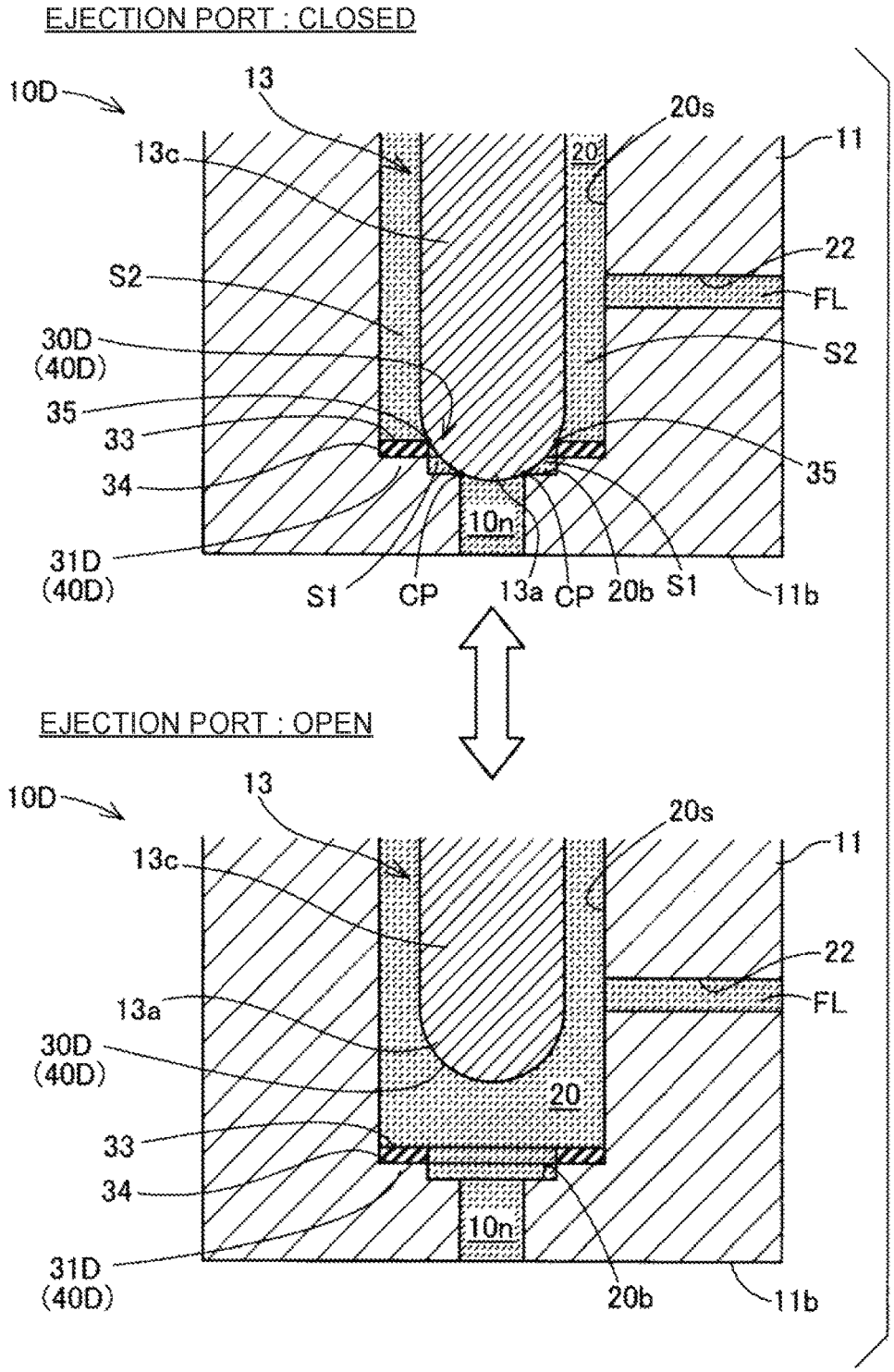
FIG. 5 is a schematic diagram for explaining a dividing mechanism according to a fourth embodiment of the invention.

FIG. 5 is a schematic diagram for explaining a dividing mechanism 40D disposed in an ejection section 10D provided to a fluid ejection device according to a fourth embodiment of the invention. In FIG. 5, the state in which the ejection port 10*n* is closed by the valving element 13 is shown in the upper part, and the state in which the ejection port 10*n* is opened is shown in the lower part. The fluid ejection device according to the fourth embodiment has substantially the same configuration as the fluid ejection device 100 (FIG. 1) according to the first embodiment except the point that the configuration of the dividing mechanism 40D disposed in the ejection section 10D is different, and the point that the configuration of the circumferential edge part of the ejection port 10*n* is different.

In the ejection section 10D of the fourth embodiment, the bottom surface 20*b* of the containing chamber 20 in which the ejection port 10*n* opens is formed as a roughly horizontal wall surface. It should be noted that in the fourth embodiment, the bottom surface 20*b* of the containing chamber 20 is not required to be roughly horizontal. Similarly to the description of the first embodiment, the bottom surface 20*b* can also be formed as a tilted wall surface having a tapered shape.

The dividing mechanism 40D according to the fourth embodiment is constituted by a valving element flaring part 30D and a containing chamber flaring part 31D. The valving element flaring part 30D is configured as a part of the tip part 13*a* having a hemispherical shape provided to the valving element 13. The valving element flaring part 30D is constituted by a part of the tip part 13*a* located on the back-end part 13*b* side of the contact region CP. The valving element flaring part 30D can be interpreted as a region formed as a curved surface region continuing outward from the area located inside the contact region CP, and flaring to the outer side of the contact region CP. It should be noted that the main body part 13*c* of the valving element 13 of the fourth embodiment has a roughly circular cylindrical shape with the diameter roughly constant throughout the range from the tip part 13*a* to the back-end part 13*b*.

The containing chamber flaring part 31D of the fourth embodiment is formed as a step part raised from the bottom surface 20*b* in a stepped manner so as to have contact with the valving element flaring part 30D when the valving element 13 blocks the ejection port 10*n*. In the containing chamber flaring part 31D, the step surface 34 as a surface opposed to the valving element flaring part 30D is formed as a roughly horizontal surface. It should be noted that the step surface 34 of the containing chamber flaring part 31D is not required to be roughly horizontal, and can be tilted so as to face to the valving element 13. The containing chamber flaring part 31D has the resin member 33. The resin member 33 is disposed so as to cover the step surface 34.

Also in the dividing mechanism 40D of the fourth embodiment, when the valving element 13 closes the ejection port 10*n*, the valving element flaring part 30D and the containing chamber flaring part 31D have contact with each other to form the boundary part 35 for dividing the containing chamber 20 into the first space S1 and the second space S2 (the upper part of FIG. 5). Thus, since the ejection port 10*n* is doubly sealed by the contact region CP in the tip part 13*a* of the valving element 13 and the boundary part 35 located above the contact region CP, the fluid FL is prevented from leaking from the ejection port 10*n* when the ejection of the fluid FL is not performed. According to the dividing mechanism 40D of the fourth embodiment, the configuration of the valving element 13 can be simplified. Further, since there is no need to dispose the step surface on the outer circumferential side surface of the valving element 13, driving of the valving element 13 can be smoothed. Besides the above, according to the dividing mechanism 40D of the fourth embodiment and the fluid ejection device equipped with the dividing mechanism 40D, a variety of functions and advantages substantially the same as those explained in the description of the first embodiment can be obtained.

E. Fifth Embodiment

Figure 6:
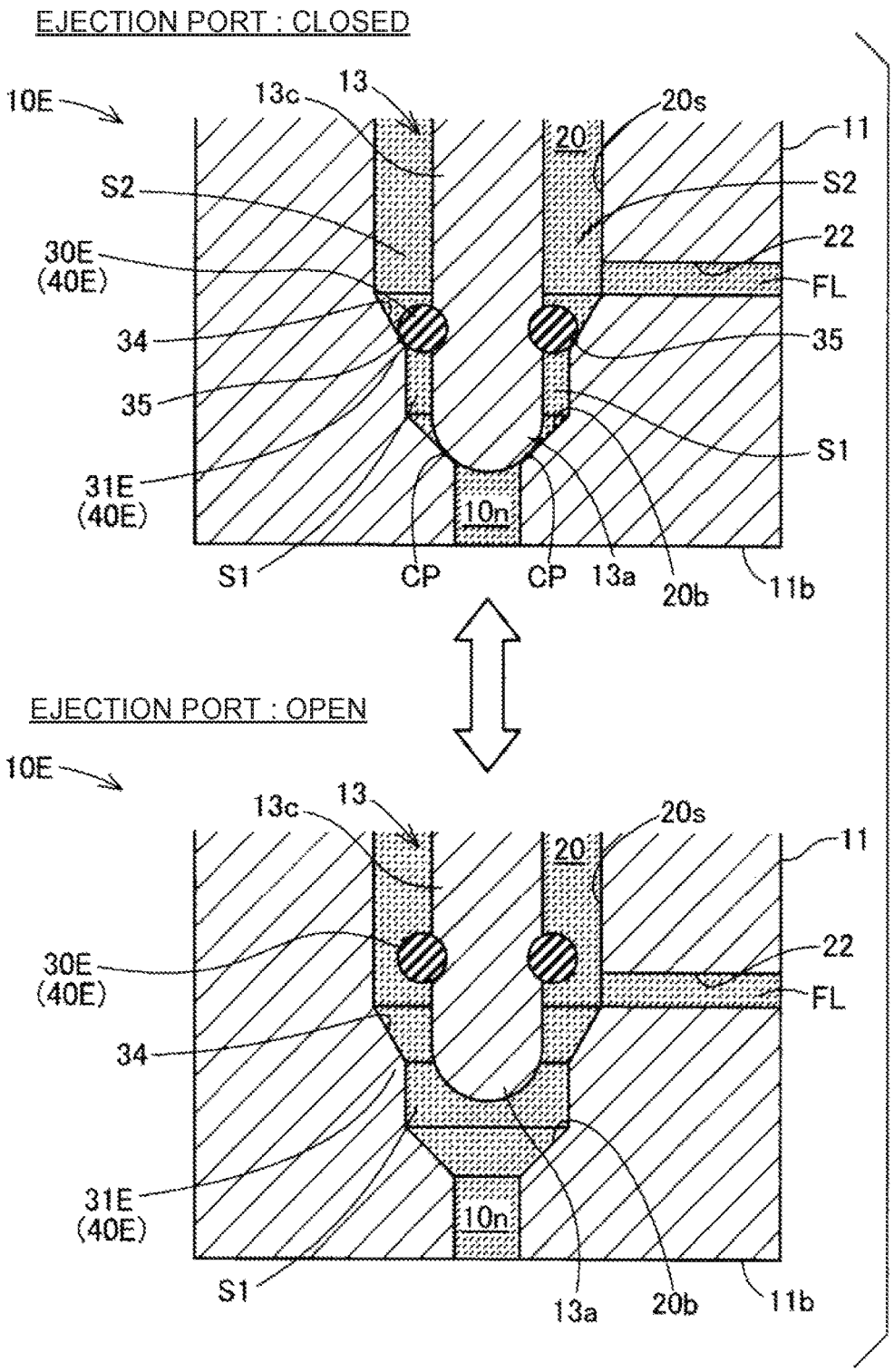
FIG. 6 is a schematic diagram for explaining a dividing mechanism according to a fifth embodiment of the invention.

FIG. 6 is a schematic diagram for explaining a dividing mechanism 40E disposed in an ejection section 10E provided to a fluid ejection device according to a fifth embodiment of the invention. In FIG. 6, the state in which the ejection port 10*n* is closed by the valving element 13 is shown in the upper part, and the state in which the ejection port 10*n* is opened is shown in the lower part. The fluid ejection device according to the fifth embodiment has substantially the same configuration as the fluid ejection device 100 (FIG. 1) according to the first embodiment except the point that the configuration of the dividing mechanism 40E disposed in the ejection section 10E is different.

The dividing mechanism 40E according to the fifth embodiment is constituted by a valving element flaring part 30E and a containing chamber flaring part 31E. The valving element flaring part 30E of the fifth embodiment is formed of a sealing member having an annular shape attached so as to surround the main body part 13*c* of the valving element 13. The valving element flaring part 30E is formed of a resin material similar to that of the resin member 33 described in the first embodiment. The valving element flaring part 30E is fitted to a circumferential recessed part provided to the main body part 13*c* of the valving element 13, and projects in the radial direction of the valving element 13 from the outer circumferential side surface of the main body part 13*c*. The containing chamber flaring part 31E of the fifth embodiment is substantially the same as the containing chamber flaring part 31A described in the first embodiment except the point that the step surface 34 is tilted so as to face to the valving element flaring part 30E.

According to the dividing mechanism 40E of the fifth embodiment, when the valving element 13 closes the ejection port 10*n*, the sealing line for constituting the boundary part 35 for blocking the communication between the first space S1 and the second space S2 of the containing chamber 20 is formed due to the contact between the valving element flaring part 30E and the containing chamber flaring part 31E (the upper part of FIG. 6). Thus, since the ejection port 10*n* is doubly sealed by the contact region CP in the tip part 13*a* of the valving element 13 and the boundary part 35 located above the contact region CP, the fluid FL is prevented from leaking from the ejection port 10*n* when the ejection of the fluid FL is not performed. Besides the above, according to the dividing mechanism 40E of the fifth embodiment and the fluid ejection device equipped with the dividing mechanism 40E, a variety of functions and advantages substantially the same as those explained in the description of the first embodiment can be obtained.

F. Sixth Embodiment

Figure 7:
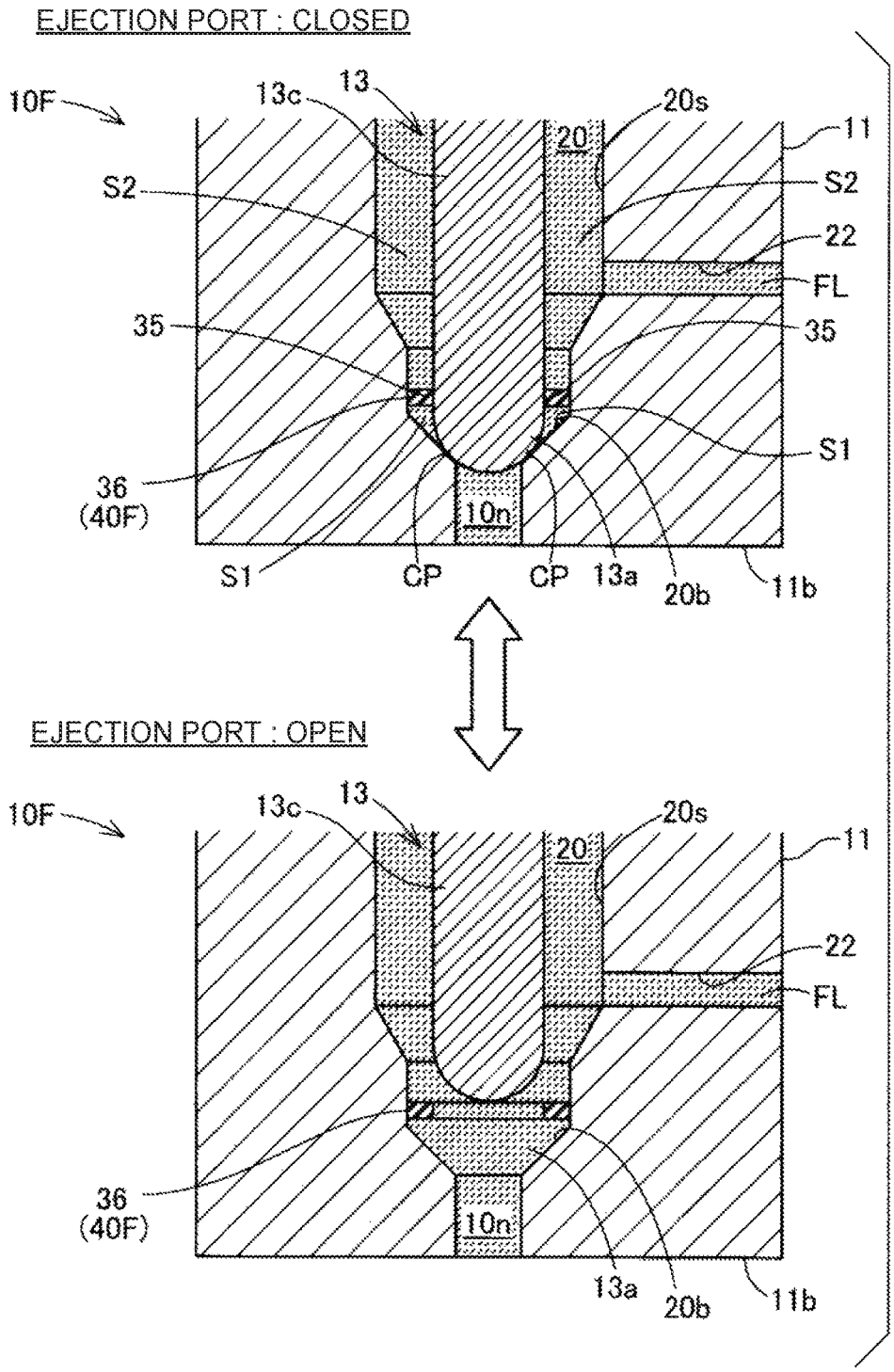
FIG. 7 is a schematic diagram for explaining a dividing mechanism according to a sixth embodiment of the invention.

FIG. 7 is a schematic diagram for explaining a dividing mechanism 40F disposed in an ejection section 10F provided to a fluid ejection device according to a sixth embodiment of the invention. In FIG. 7, the state in which the ejection port 10*n* is closed by the valving element 13 is shown in the upper part, and the state in which the ejection port 10*n* is opened is shown in the lower part. The fluid ejection device according to the sixth embodiment has substantially the same configuration as the fluid ejection device 100 (FIG. 1) according to the first embodiment except the point that the configuration of the dividing mechanism 40F is different, and the point that the main body part 13*c* of the valving element 13 has a diameter roughly constant throughout the range from the tip part 13*a* to the back-end part 13*b*.

The dividing mechanism 40F of the sixth embodiment is formed of a projection part 36 disposed on the inner wall surface 20*s* of the containing chamber 20. The projection part 36 is formed of a sealing member having an annular shape and fixed to the inner wall surface 20*s* of the containing chamber 20. The projection part 36 is formed of a resin material similar to that of the resin member 33 described in the first embodiment. The projection part 36 can also be formed of an O-ring, the outer circumferential region of which is embedded in the inner wall surface 20*s* of the containing chamber 20. The projection part 36 is disposed at a position separated from the ejection port 10*n* in the direction from the tip part 13*a* toward the back-end part 13*b* of the valving element 13. When viewed along the direction of the reciprocation of the valving element 13, the projection part 36 surrounds the ejection port 10*n* and projects toward the ejection port 10*n*. The inner diameter of the projection part 36 is roughly equal to or slightly smaller than the diameter of the main body part 13*c* of the valving element 13.

The tip part 13*a* of the valving element 13 is located above the projection part 36 when the tip part 13*a* is located at the furthest position from the ejection port 10*n* (the lower part of FIG. 7). When the valving element 13 moves toward the ejection port 10*n*, the tip part 13*a* passes through the area surrounded by the projection part 36 and reaches the ejection port 10*n*. When the tip part 13*a* blocks the ejection port 10*n*, the inner circumferential surface of the projection part 36 has contact with the outer circumferential side surface of the main body part 13*c* of the valving element 13 to thereby form the sealing line for constituting the boundary part 35 for dividing the internal space of the containing chamber 20 into the first space S1 and the second space S2 (the upper part of FIG. 7).

As described above, according to the dividing mechanism 40F of the sixth embodiment, since the internal space of the containing chamber 20 is divided by the projection part into the first space S1 and the second space S2 the communication state of which is blocked when the valving element 13 closes the ejection port 10*n*, the fluid FL is prevented from leaking from the ejection port 10*n*. According to the fluid ejection device related to the sixth embodiment, the dividing mechanism 40F is formed of the projection part 36 disposed on the inner wall surface 20*s* of the containing chamber 20, and the configuration of the dividing mechanism 40F is simplified. Besides the above, according to the dividing mechanism 40F of the sixth embodiment and the fluid ejection device equipped with the dividing mechanism 40F, a variety of functions and advantages substantially the same as those explained in the description of the first embodiment can be obtained.

G. Seventh Embodiment

Figure 8:
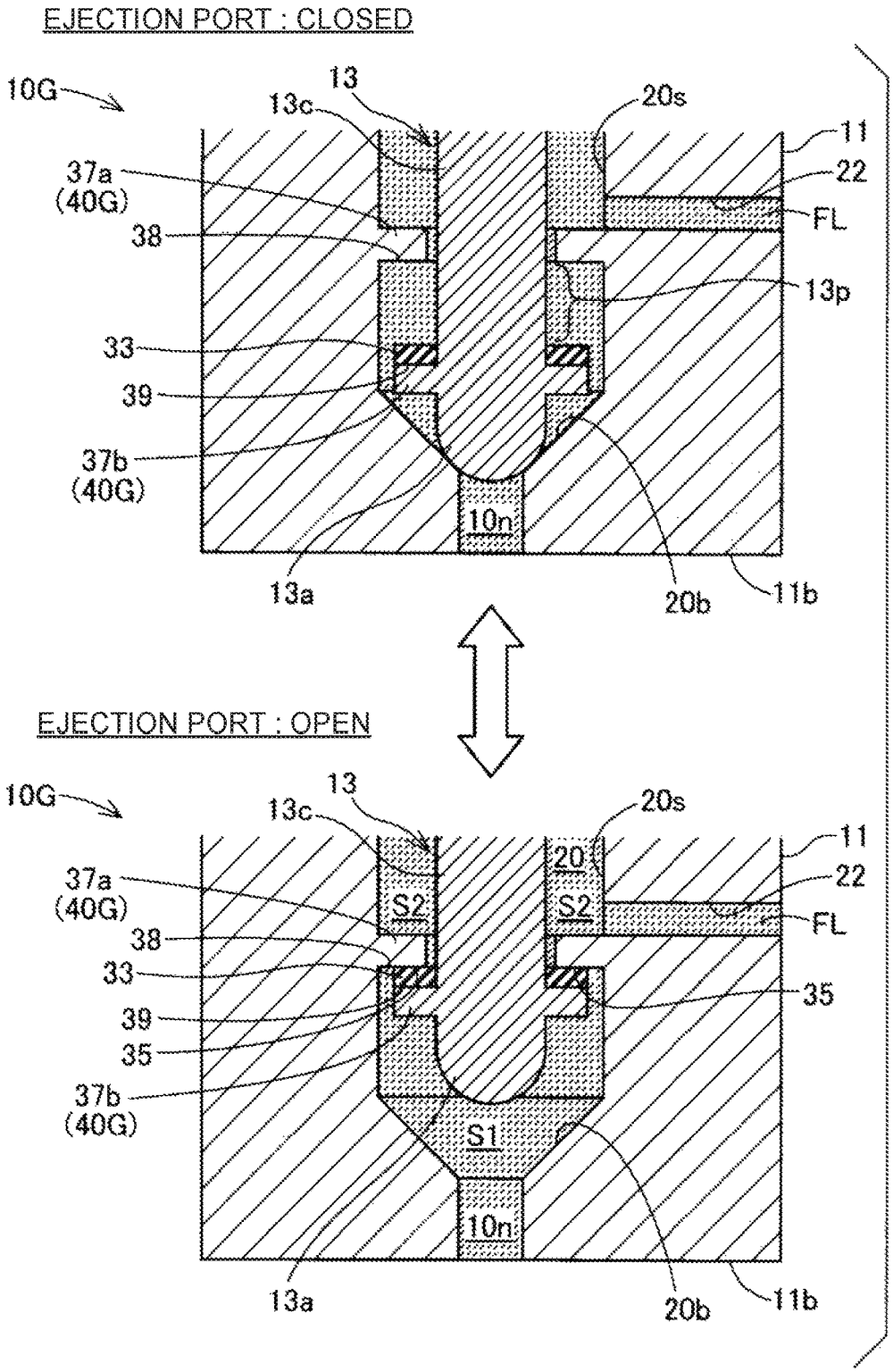
FIG. 8 is a schematic diagram for explaining a dividing mechanism according to a seventh embodiment of the invention.

FIG. 8 is a schematic diagram for explaining a dividing mechanism 40G disposed in an ejection section 10G provided to a fluid ejection device according to a seventh embodiment of the invention. In FIG. 8, the state in which the ejection port 10*n* is closed by the valving element 13 is shown in the upper part, and the state in which the ejection port 10*n* is opened is shown in the lower part. The fluid ejection device according to the seventh embodiment has substantially the same configuration as the fluid ejection device 100 (FIG. 1) according to the first embodiment except the points described below.

In the fluid ejection device according to the seventh embodiment, in the resting period in which the ejection of the fluid FL is not performed for predetermined time or more, the ejection section 10G keeps the valving element 13 stopping at the position where the tip part 13*a* is located the furthest from the ejection port 10*n* until the ejection of the fluid FL is resumed. In other words, in the fluid ejection device according to the seventh embodiment, the position where the tip part 13*a* of the valving element 13 is the furthest from the ejection port 10*n* is the predetermined stopping position of the valving element 13. In the fluid ejection device according to the seventh embodiment, since the dividing mechanism 40G described hereinafter is disposed in the containing chamber 20, even in the case in which the valving element 13 is located at the stopping position described above to keep the ejection port 10*n* in the open state, the leakage of the fluid from the ejection port 10*n* is prevented.

The dividing mechanism 40G of the seventh embodiment is constituted by a first flaring part 37*a* provided to the containing chamber 20 and a second flaring part 37*b* provided to the valving element 13. The first flaring part 37*a* constitutes a part of the inner wall surface 20*s* of the containing chamber 20. The first flaring part 37*a* is disposed between the communication port 22 and the ejection port 10*n* in the direction in which the valving element 13 reciprocates. The first flaring part 37*a* is formed as a projection part having an annular shape surrounding the outer circumference of the valving element 13. The first flaring part 37*a* surrounds the outer circumference of the valving element 13, and at the same time flares toward the ejection port 10*n* when viewed from the tip part 13*a* side of the valving element 13 along the direction in which the valving element 13 reciprocates. The first flaring part 37*a* has a first opposed surface 38 opposed to the second flaring part 37*b* described below in the direction in which the valving element 13 reciprocates. The first opposed surface 38 is a roughly horizontal surface facing downward. The first opposed surface 38 can also be tilted.

The second flaring part 37*b* is formed as a projection part having a flange shape disposed on the outer circumferential side surface of the main body part 13*c* of the valving element 13. The second flaring part 37*b* is disposed in a region located on the tip part 13*a* side of a passing region 13*p*, which passes through the area surrounded by the first flaring part 37*a* during the reciprocation of the valving element 13. The passing region 13*p* is a part of the main body part 13*c*, and is a region located on the lower side of the first flaring part 37*a* when the tip part 13*a* of the valving element 13 blocks the ejection port 10*n* (the upper part of FIG. 8). In other words, the second flaring part 37*b* is located on the lower side of the first flaring part 37*a*. The second flaring part 37*b* flares to the outside of the passing region 13*p* throughout the outer circumference of the valving element 13 when viewed from the back-end part 13*b* side along the direction in which the valving element 13 reciprocates. The second flaring part 37*b* overlaps the first flaring part 37*a* when viewed from the back-end part 13*b* side along the direction in which the valving element 13 reciprocates. Between the second flaring part 37*b* and the inner wall surface 20*s* located on the side of containing chamber 20, there is formed a gap for making the fluid FL flow through. The second flaring part 37*b* has a second opposed surface 39 opposed to the first opposed surface 38 of the first flaring part 37*a* described above in the direction in which the valving element 13 reciprocates. The second opposed surface 39 is a roughly horizontal surface facing upward. In the case in which the first opposed surface 38 is tilted, the second opposed surface 39 can also be tilted accordingly. The second flaring part 37*b* has the resin member 33. The resin member 33 is disposed so as to cover the second opposed surface 39 of the second flaring part 37*b*.

The first flaring part 37*a* and the second flaring part 37*b* have contact with each other to form the boundary part 35 when the valving element 13 is located at the stopping position (the lower part of FIG. 8). Thus, the containing chamber 20 is divided into the first space S1 and the second space S2. The first space S1 is formed when the tip part 13*a* of the valving element 13 moves upward, and therefore becomes in the state of negative pressure or low pressure approximate to the negative pressure. Therefore, even if the ejection port 10*n* is opened, the fluid FL is kept in the first space S1. Therefore, the fluid is prevented from leaking from the ejection port 10*n* during the resting period in which the ejection of the fluid FL is not performed. Besides the above, according to the dividing mechanism 40G of the seventh embodiment and the fluid ejection device equipped with the dividing mechanism 40G, a variety of functions and advantages substantially the same as those explained in the description of the first embodiment can be obtained.

H. Modified Examples

The configuration of each of the embodiments described above can be modified as follows. In the following descriptions, the fluid ejection devices of the respective embodiments are collectively referred to as a "fluid ejection device" including the fluid ejection device 100 according to the first embodiment unless otherwise noted. Further, the dividing mechanisms 40A through 40G of the respective embodiments are collectively referred to as a "dividing mechanism" unless otherwise noted. Constituents having the same functions and configurations as the constituents described in the above embodiments are described with the same reference symbols attached.

H1. Modified Example 1

In the dividing mechanism of the embodiments described above except the fifth embodiment and the sixth embodiment, the resin member 33 is provided to either one of the valving element 13 or the inner wall surface 20*s* of the containing chamber 20. In contrast, the resin member 33 provided to the valving element 13 can be moved to the containing chamber 20, and the resin member 33 provided to the inner wall surface 20*s* of the containing chamber 20 can be moved to the valving element 13. Alternatively, the resin member 33 can be provided to both of the valving element 13 and the inner wall surface 20*s* of the containing chamber 20, or can be provided to neither the valving element 13 nor the inner wall surface 20*s* of the containing chamber 20.

H2. Modified Example 2

In each of the embodiments described above, the tip part 13*a* of the valving element 13 has the hemispherical shape. In contrast, the shape of the tip part 13*a* of the valving element 13 is not limited to the hemispherical shape. For example, the tip part 13*a* can also have a flat end surface at the top thereof. Further, the tip part 13*a* can also have a disk-like shape arranged horizontally. In each of the embodiments described above, the horizontal cross-section of each of the regions of the valving element 13 has a roughly circular shape. In contrast, the shape of the horizontal cross-section of each of the regions of the valving element 13 is not limited to the roughly circular shape, but can also be an elliptical shape, or a polygonal shape such as a triangular shape or a quadrangular shape.

H3. Modified Example 3

The fluid ejection device according to each of the embodiments described above is configured as a 3D printer for ejecting the fluid FL to form a three-dimensional article. In contrast, the fluid ejection device can also be configured as, for example, an inkjet printer for ejecting ink to form an image. In this case, the ink as the fluid FL is ejected toward a printed medium or a recording medium instead of the shaping stage 60. Besides the above, the fluid ejection device can also be configured as an adhesive application device for ejecting a liquid adhesive to apply the liquid adhesive. Further, the fluid ejection device according to each of the embodiments described above ejects the liquid material, which is used for the manufacture of a three-dimensional article, as the fluid FL. In contrast, it is also possible for the fluid ejection device according to each of the embodiments described above to eject a gas, or a fluid such as a power having liquidity as the fluid FL.

The invention is not limited to the embodiments, specific examples, and the modified examples described above, but can be implemented with a variety of configurations within the scope or the spirit of the invention. For example, the technical features in the embodiments, the specific examples, and the modified examples corresponding to the technical features in the aspects described in SUMMARY section can appropriately be replaced or combined in order to solve all or a part of the problems described above, or in order to achieve all or a part of the advantages described above. Further, the technical feature can arbitrarily be eliminated unless described in the specification as an essential element.

The entire disclosure of Japanese Patent No. 2016-143103, filed Jul. 21, 2016 is expressly incorporated by reference herein.

What is claimed is:

1. A fluid ejection device comprising:

a chamber that contains a fluid, the chamber having a chamber projection that inwardly extends from an inner wall of the chamber;

an ejection port that is provided at the chamber so as to be fluidly connected to the chamber, the ejection port being configured to eject the fluid;

a valve member that is slidably provided in the chamber, the valve member being selectively positioned in first and second states, a tip of the valve member closing the ejection port in the first state, the tip of the valve member being spaced apart from the ejection port in the second state, the valve member having a valve projection that outwardly extends from a periphery of the valve member; and a communication port that is provided at the chamber and that is fluidly connected between a fluid supply and the chamber, wherein the chamber projection is located between the ejection port and the communication port in a cross sectional view, the valve projection is located between the ejection port and the chamber projection in the cross sectional view, when the valve member is in the second state, the chamber projection contacts the valve projection so that an inner space of the chamber is divided into first and second spaces and the fluid in the chamber is physically separated into the first and second spaces, and only the second space fluidly communicates with the communication port, and when the valve member is in the first state, the chamber projection is spaced apart from the valve projection so that the communication port and the inner space of the chamber fluidly communicate with each other.

2. The fluid ejection device according to claim 1, wherein when the valve member is in the second state, a first surface of the chamber projection contacts a second surface of the valve projection, and a resin member is provided on at least one of the first surface and the second surface.

3. A fluid ejection device comprising:

a chamber that contains a fluid, the chamber having a chamber step that inwardly extends from an inner wall of the chamber, the chamber step having a chamber planer surface;

an ejection port that is provided at the chamber so as to be fluidly connected to the chamber, the ejection port being configured to eject the fluid;

a valve member that is slidably provided in the chamber, the valve member being selectively positioned in first and second states, a tip of the valve member closing the ejection port in the first state, the tip of the valve member being spaced apart from the ejection port in the second state, the valve member having a valve projection that outwardly extends from a periphery of the valve member, the valve projection having a valve planer surface extending to cross a side wall of the valve member; and a communication port that is provided at the chamber and that is fluidly connected between a fluid supply and the chamber, wherein the chamber step is located between the ejection port and the communication port in a cross sectional view, when the valve member is in the first state, the chamber planer surface of the chamber step contacts the valve planer surface of the valve projection so that an inner space of the chamber is divided into first and second spaces and the fluid in the chamber is physically separated into the first and second spaces, and only the second space fluidly communicates with the communication port, when the valve member is in the second state, the chamber planer surface of the chamber step is spaced apart from the valve planer surface of the valve projection so that the communication port, the inner space of the chamber, and the ejection port fluidly communicate with each other, and wherein a resin member is provided on at least one of the chamber planer surface and the valve planer surface.

* * * * *